US008693904B2

(12) United States Patent
Ishizumi et al.

(10) Patent No.: US 8,693,904 B2
(45) Date of Patent: Apr. 8, 2014

(54) IMAGE FORMING APPARATUS

(75) Inventors: Keisuke Ishizumi, Mishima (JP); Seiji Saito, Mishima (JP); Tomoo Akizuki, Suntou-gun (JP); Takeshi Shinji, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 335 days.

(21) Appl. No.: 13/280,751

(22) Filed: Oct. 25, 2011

(65) Prior Publication Data

US 2012/0106998 A1 May 3, 2012

(30) Foreign Application Priority Data

Oct. 29, 2010 (JP) ..... 2010-243804

(51) Int. Cl.
*G03G 15/02* (2006.01)

(52) U.S. Cl.
USPC ..... 399/50; 399/51; 399/71; 399/129; 399/302

(58) Field of Classification Search
USPC ..... 399/50, 71, 129, 226, 227, 302, 51
See application file for complete search history.

(56) References Cited

U.S. PATENT DOCUMENTS

| | | | | |
|---|---|---|---|---|
| 2003/0219286 | A1* | 11/2003 | Soda et al. | 399/302 |
| 2006/0083558 | A1* | 4/2006 | Tomizawa | 399/302 |
| 2008/0298832 | A1* | 12/2008 | Hara | |
| 2011/0188881 | A1* | 8/2011 | Akizuki et al. | 399/129 |

FOREIGN PATENT DOCUMENTS

| | | | |
|---|---|---|---|
| JP | 2004-062085 | A | 2/2004 |
| JP | 2008-299251 | A | 12/2008 |
| JP | 2009014870 | A | 1/2009 |
| JP | 2010-112992 | A | 5/2010 |

* cited by examiner

*Primary Examiner* — David Gray
*Assistant Examiner* — Laura Roth
(74) *Attorney, Agent, or Firm* — Canon USA, Inc., IP Division

(57) ABSTRACT

An image forming apparatus may include a first and second mode. In the first mode, the image forming apparatus uses a second charging member to charge toner that remains on an intermediate transfer member and then transfers the charged, remaining toner to an image carrier in a primary transfer portion. In the second mode, the image forming apparatus transfers the remaining toner adhered to the second charging member in the first mode to the intermediate transfer member. Also in a second mode, the image forming apparatus controls so that a surface potential of the image carrier that reaches the primary transfer portion at a timing at which the remaining toner transferred to the intermediate transfer member passes through the primary transfer portion has a same polarity as that of a surface potential of the image carrier in the first mode and also has an absolute value smaller than that thereof.

9 Claims, 9 Drawing Sheets

L1/Ps ≥ L3/Ps

L1/Ps ≤ L3/Ps

L1/Ps ≥ L3/Ps

L1/Ps ≤ L3/Ps

L1/Ps ≥ L2/Ps

L1/Ps ≤ L2/Ps

L1/Ps ≥ L2/Ps

L1/Ps ≤ L2/Ps

IMAGE FORMING APPARATUS

BACKGROUND OF THE INVENTION

1. Field of the Invention

The present invention relates to an image forming apparatus that transfers a toner image formed on an intermediate transfer member to a transfer material.

2. Description of the Related Art

Conventionally, an electrophotographic method using an intermediate transfer method is well known to be used in an image forming apparatus that forms a multiple color image (color image) to a transfer material such as a sheet. With the intermediate transfer method, a plurality of color toners is primarily transferred from an image carrier that carries a toner image to an intermediate transfer member rotated. Thus, a color toner image is formed on the intermediate transfer member. Then, the color toner image formed on the intermediate transfer member is secondarily transferred to the transfer material, thereby forming an image to the transfer material.

On the intermediate transfer member, there is a remaining toner that is not secondarily transferred to the transfer material. A cleaning method is conventionally discussed to remove the remaining toner. As an example of the cleaning method, the remaining toner is charged by a charging member with an opposite polarity of a normal polarity of the toner, and is transferred to the image carrier. In the cleaning, with the increase in number of printed sheets, a part of the remaining toner is adhered to the charging member. Thus, there is an issue of reduction in toner charge performance of the charging member. Japanese Patent Application Laid-Open No. 2004-62085 discusses a method for periodically transferring the remaining toner adhered to the charging member onto the intermediate transfer member.

However, when transferring the remaining toner adhered to the charging member onto the intermediate transfer member, it is necessary to transfer the remaining toner from the intermediate transfer member to a photosensitive drum before the next image formation. If the remaining toner is not sufficiently transferred from the intermediate transfer member to the photosensitive drum, the remaining toner is transferred to the transfer material and may cause an image defect. The charging polarity of the remaining toner is not always uniform. Thus, there is an issue that the remaining toner cannot be effectively transferred from the intermediate transfer member to the photosensitive drum.

SUMMARY OF THE INVENTION

According to an aspect of the present invention, an image forming apparatus includes an image carrier configured to carry a toner image, a first charging member configured to charge the image carrier, a first voltage-application unit configured to apply a negative polarity voltage with a same polarity as that of a normal charging polarity of a toner to the first charging member, an exposure unit configured to expose the image carrier to light, a movable intermediate transfer member, a primary transfer member configured to primarily transfer the toner image from the image carrier to the intermediate transfer member in a primary transfer portion, a secondary transfer member configured to secondarily transfer the toner image from the intermediate transfer member to a transfer material in a secondary transfer portion, and a second charging member configured to charge a remaining toner that remains on the intermediate transfer member upstream of the primary transfer portion and downstream of the secondary transfer portion in a movement direction of the intermediate transfer member. The image forming apparatus can execute a first mode for charging the remaining toner by the second charging member and transferring the charged remaining toner from the intermediate transfer member to the image carrier in the primary transfer portion, and execute a second mode for transferring the remaining toner adhered to the second charging member in the first mode from the second charging member to the intermediate transfer member, and in response to the image forming apparatus executing the second mode, the image forming apparatus controls the first voltage-application unit or the exposure unit so that a surface potential of the image carrier that reaches the primary transfer portion at a timing at which the remaining toner transferred from the second charging member to the intermediate transfer member passes through the primary transfer portion has a same polarity as that of a surface potential of the image carrier in the first mode and also has an absolute value smaller than that thereof.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings. In an example, a surface potential of an image carrier that reaches a primary transfer portion at a timing at which a discharge toner transferred from a second charging member to an intermediate transfer member passes through the primary transfer portion has the same polarity as and a smaller absolute value than that of a surface potential of the image carrier charged by a first charging member in a cleaning mode.

Figure 1:
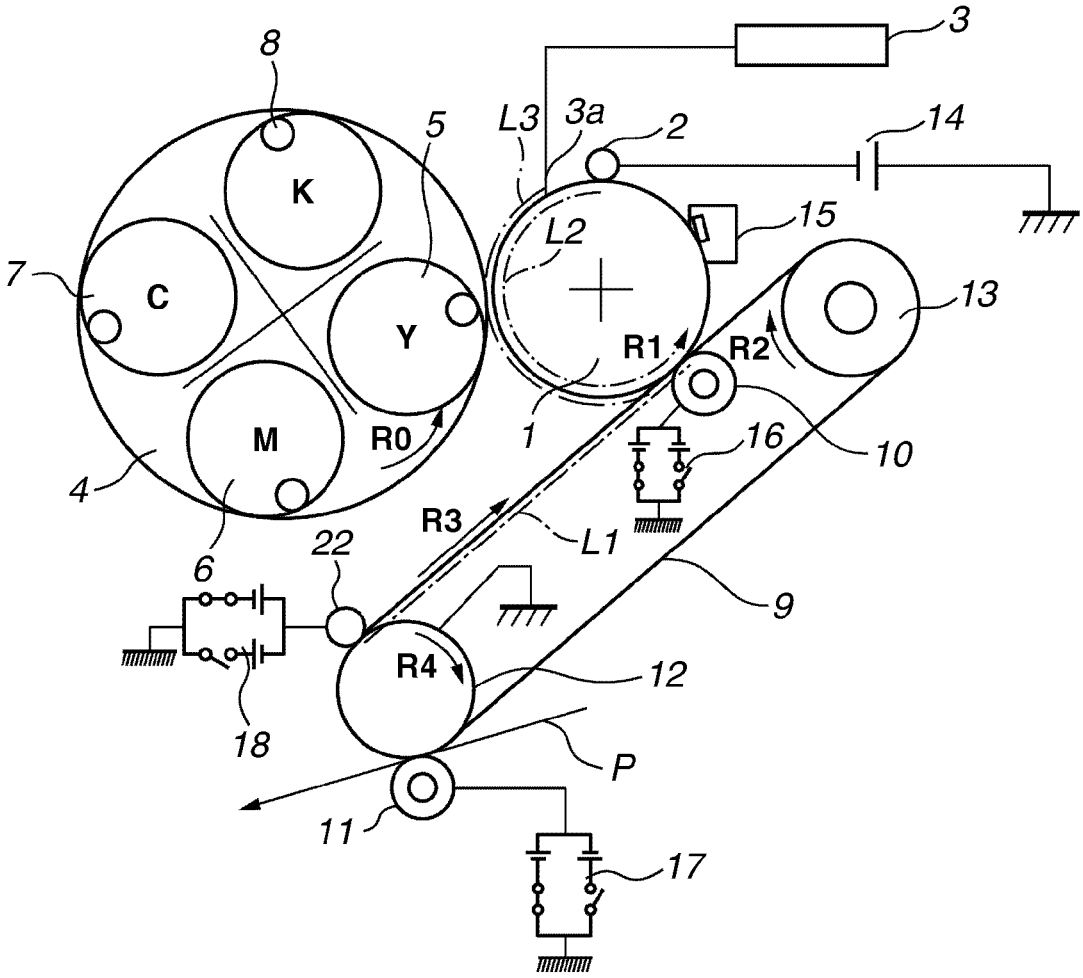
FIG. 1 illustrates a schematic configuration of an image forming apparatus according to a first exemplary embodiment.

FIG. 1 illustrates a schematic configuration of an image forming apparatus according to a first exemplary embodiment. The image forming apparatus according to the first exemplary embodiment employs an electrophotographic method using an intermediate transfer method. The image forming apparatus according to the first exemplary embodiment illustrated in FIG. 1 includes a photosensitive drum 1 as an image carrier and a charging roller 2 as a first charging member. Further, the image forming apparatus includes developing devices 5 to 8, a rotary member 4 as a holding member in which the developing devices 5 to 8 are mounted, an intermediate transfer belt 9 as a movable intermediate transfer member, and a primary transfer roller 10 as a primary transfer member. Furthermore, the image forming apparatus includes a secondary transfer roller 11 as a secondary transfer member that can abut on and separate from the intermediate transfer belt 9, and a conductive roller 22 that can abut on and separate from the intermediate transfer belt 9. The conductive roller 22 is a second charging member.

Referring to FIG. 1, the photosensitive drum 1 as an image carrier that carries a toner image is rotated in the direction of an arrow R1 by a drive unit (not illustrated). The surface of the photosensitive drum 1 is uniquely charged by the charging roller 2 to which a voltage of about −1100 V is applied by a high-voltage power supply 14 (i.e., a first voltage-application device). The high-voltage power supply 14 can apply a voltage with the same polarity as a normal polarity of a toner (voltage with the negative polarity according to the present exemplary embodiment) to the charging roller 2.

The charging roller 2 as a first charging member charges the photosensitive drum 1. An exposure device 3 emits laser beams according to image information to the surface of the photosensitive drum 1 that is uniquely charged, so that a latent image is formed onto the photosensitive drum 1. Further, the photosensitive drum 1 moves in the direction illustrated by an arrow R1, and a developing unit then develops the latent image formed on the photosensitive drum 1 as a toner image.

The developing unit includes the developing device 5 that develops a yellow toner, the developing device 6 that develops a magenta toner, the developing device 7 that develops a cyan toner, and the developing device 8 that develops a black toner. Further, the developing unit includes the rotary member 4 as the holding member that holds the developing devices 5 to 8. The rotary member 4 is rotated, thereby moving the respective developing devices to a developing position facing to the photosensitive drum 1.

When a full-color image is formed, images are sequentially developed in order of yellow, magenta, cyan, and black. More specifically, the rotary member 4 is rotated in the direction illustrated by an arrow R0, so that the developing devices 5 to 8 sequentially move to a contact position with the photosensitive drum 1 and the respective color images are developed.

In the rotational direction of the photosensitive drum 1, the intermediate transfer belt 9 is disposed downstream of the contact position of the photosensitive drum 1 and the developing devices 5 to 8. The intermediate transfer belt 9 as the intermediate transfer member is rotated at approximately the same velocity as that of the photosensitive drum 1.

The intermediate transfer belt 9 as the intermediate transfer member is a resin endless belt with a surface resistivity of about $5.0\times10^{10}$ Ω/sq, a volume resistivity of about $2.0\times10^{11}$ Ω·cm, a relative permittivity of 3, and a thickness of 100 μm. The intermediate transfer belt 9 comes into contact with the photosensitive drum 1. A drive roller 12 is rotated by a drive motor (not illustrated) in the direction illustrated by an arrow R4. The drive roller 12 rotates the intermediate transfer belt 9 at a circumferential velocity of 100 mm/sec similar to that of the photosensitive drum 1 in the direction illustrated by an arrow R3. The surface resistivity of the intermediate transfer belt 9 is measured by Hiresta MP-CHT450 manufactured by MITSUBISHI CHEMICAL CO., LTD.

The primary transfer roller 10 as the primary transfer member is disposed at the opposite position to the photosensitive drum 1 via the intermediate transfer belt 9. The primary transfer roller 10 forms a primary transfer portion with the photosensitive drum 1 via the intermediate transfer belt 9. A positive polarity direct current (DC) voltage of about +900 V is applied to the primary transfer roller 10. Thus, the toner image formed on the photosensitive drum 1 is primarily transferred onto the intermediate transfer belt 9. A high-voltage power supply 16 for primary transfer is a voltage application unit that applies a voltage with negative or positive polarity to the primary transfer roller 10. A description is given of the reason of applying the negative polarity voltage to the primary transfer roller 10 below.

More specifically, the yellow toner image developed to the photosensitive drum 1 by the developing device 5 is primarily transferred from the photosensitive drum 1 to the intermediate transfer belt 9. The similar mode is performed to the magenta toner, the cyan toner, and the black toner, so that multiple color toner images are formed on the intermediate transfer belt 9.

When the multiple color toner images are formed on the intermediate transfer belt 9, the secondary transfer roller 11 and the conductive roller 22 disposed on an outer-circumferential surface side of the intermediate transfer belt 9 are separated from the intermediate transfer belt 9. This is to prevent the secondary transfer roller 11 and the conductive roller 22 from contacting the toner image on the intermediate transfer belt 9 and spoiling the image. The position of the conductive transfer roller 11 is disposed downstream of a secondary transfer portion and upstream of the primary transfer portion in the movement direction of the intermediate transfer belt 9.

The secondary transfer roller 11 and the conductive roller 22 come into contact with the outer circumferential surface of the intermediate transfer belt 9 stretched around the drive roller 12 just before the leading edge of the image reaches the secondary transfer roller 11 during executing the primary transfer of the black toner image. In this case, a positive polarity DC voltage of about +2500V is applied to the secondary transfer roller 11 and the conductive roller 22, respectively. After the secondary transfer roller 11 comes into contact with intermediate transfer belt 9, a transfer material P is conveyed by a sheet feeding roller, and is supplied to the secondary transfer portion with which the intermediate transfer belt 9 and the secondary transfer roller 11 come into contact at a predetermined timing. The DC voltage of about +2500 V is applied to the secondary transfer roller 11, thereby secondarily transferring the multiple color toner images from the intermediate transfer belt 9 to the transfer material P.

The DC voltage of about +2500 V is applied to the conductive roller 22, thereby charging, to the positive polarity, a toner remaining on the intermediate transfer belt 9 without the secondary transfer (hereinafter, referred to as the remaining toner). In other words, the conductive roller 22, which serves as a second charging member, charges the remaining toner. Further, the conductive roller 22A is connected to a high-voltage power supply 18, which serves as a second voltage-application unit that can output both the positive and negative polarity voltages. The transfer material P passes through the secondary transfer portion. Then, application of the DC voltage to the secondary transfer roller 11 and the conductive roller 22 is stopped, and the secondary transfer roller 11 and the conductive roller 22 are separated from the intermediate transfer belt 9.

The image forming apparatus according to the present exemplary embodiment can execute a first mode for cleaning the remaining toner.

The cleaning mode of the remaining toner as the first mode is described below. The remaining toner is mainly charged to the negative polarity. The remaining toner is charged to the positive polarity by a discharge current, which is generated when a positive polarity DC voltage of about 2500 V is applied to the conductive roller 22. When the next yellow image is primarily transferred in the primary transfer portion, the remaining toner is simultaneously transferred to the photosensitive drum 1. At that time, the high-voltage power supply 14 applies a voltage of about −1100 V to the charging roller 2, and the photosensitive drum 1 uniformly charged by the charging roller 2 has the surface potential about −550 V. In addition, a voltage of about +900 V is applied to the primary transfer roller 10. With respect to the surface potential of the photosensitive drum 1, the next yellow image may not be primarily transferred, but only the remaining toner may be transferred to the photosensitive drum 1.

The remaining toner adhered to the photosensitive drum 1 is finally collected to a cleaning device 15 for removing the remaining toner. When the remaining toner is returned to the photosensitive drum 1 in the primary transfer of the yellow toner image, the remaining toner is transferred to both an unexposed portion (dark portion) and an exposed image portion (bright portion) on the photosensitive drum 1.

As described above, in the cleaning mode of the remaining toner, the high-voltage power supply 16 applies a positive polarity DC voltage of about 900 V to the primary transfer roller 10, and the high-voltage power supply 14 applies a voltage of about −1100 V to the charging roller 2. Therefore, during the cleaning mode of the remaining toner, with respect to the surface potential of an image portion on the photosensitive drum 1, a potential of an unexposed image portion is kept to about −550 V from the start to the end of the image formation in continuous printing.

The transfer material P passing though a secondary transfer nip portion is conveyed to a fixing device (not illustrated). The fixing device fixes the toner image. The transfer material P with the fixed toner image is discharged and conveyed as an image formation product (printed sheet or copied sheet). In continuous image formation, the next yellow image is primarily transferred just after ending of the primary transfer of the black. Then, the above described image formation processing is repeated.

The remaining toner mainly containing the toner that is charged to the negative polarity is charged to the positive polarity by applying a positive polarity DC voltage to the conductive roller 22. However, the polarity of a part of the toner is not reversed, i.e., the negative one yet. Therefore, a part of the remaining toner is adhered to the conductive roller 22 to which a voltage of about +2500 V is applied. As increasing the amount of toner adhered to the conductive roller 22, the toner charge performance of the conductive roller 22 deteriorates. The remaining toner, which is not sufficiently charged to the positive polarity because of the deterioration in toner charge performance, is not collected to the photosensitive drum 1. Thus, at the next image formation time, the remaining toner may be transferred to the transfer material P and cause an image defect.

For the reason described above, after ending the image formation, the toner adhered to the conductive roller 22 needs to be transferred onto the intermediate transfer belt 9 again to recover the toner charge performance of the conductive roller 22.

Hereinbelow, a mode in which the toner adhered to the conductive roller 22 is transferred onto the intermediate transfer belt 9 after ending of the image formation, is further transferred to the photosensitive drum 1, and is finally collected by a cleaning device 15 on the photosensitive drum 1, is referred to as a post-rotation mode. The post-rotation mode may be executed to every printed sheet. In the continuous printing, the post-rotation mode may be executed at a predetermined timing. According to the present exemplary embodiment, in the continuous printing, the post-rotation mode is executed at a timing for ending the final printing.

The toner adhered to the conductive roller 22 as the conductive member is mainly charged to the negative polarity. Therefore, if a negative polarity voltage is applied to the conductive roller 22, the toner adhered to the conductive roller 22 can be thus discharged (can be transferred) onto the intermediate transfer belt 9.

A mode for discharging the toner from the conductive roller 22 to the intermediate transfer belt 9, more specifically, a mode for transferring the toner adhered to the second charging member in the first mode to the intermediate transfer member is defined as a second mode.

According to the present exemplary embodiment, the high-voltage power supply (second voltage-application unit) 18 that applies the DC voltage to the conductive roller 22 can apply both the positive and negative polarity DC voltages to the conductive roller 22. According to the present exemplary embodiment, the toner adhered by applying a voltage of about −1000 V to the conductive roller 22 is transferred again to the intermediate transfer belt 9.

A time period for applying the negative polarity voltage corresponds to one lap of the conductive roller 22. The conductive roller 22 has a circumference of about 30 mm. With the rotation of the intermediate transfer belt 9, the conductive roller 22 is rotated and a time for one lap of the conductive roller 22 is about 300 milliseconds. The high-voltage power supply 18 requires about 100 milliseconds as a rise time for applying the negative polarity voltage. Accordingly, in the present exemplary embodiment, the time period for applying the voltage of about −1000 V is set to about 400 milliseconds.

A discharge toner is a toner transferred again from the conductive roller 22 to the intermediate transfer belt 9. The discharge toner mainly has the negative polarity. Therefore, when the discharge toner passes through the photosensitive drum 1, a negative polarity voltage is applied to the primary transfer roller 10, and the discharge toner can be transferred to the photosensitive drum 1. In the present exemplary embodiment, a voltage of about −1000 V is applied to the primary transfer roller 10.

A part of the discharge toner may not be collected to the photosensitive drum 1 but remains on the intermediate transfer belt 9 (hereinbelow, the toner is referred to the remaining discharge toner). Therefore, after discharging the toner, a positive polarity voltage of about +2500 V is applied again to the conductive roller 22 to charge the remaining discharge toner on the intermediate transfer belt 9 to the positive polarity.

The remaining discharge toner charged to the positive polarity is collected by applying a voltage of about +900 V to the primary transfer roller 10 and by the photosensitive drum 1 which is charged by the charging roller 22 to which the voltage of about −1100 V is applied. As described above, the post-rotation mode according to the present exemplary embodiment is performed.

The post-rotation mode includes a mode for charging the remaining discharge toner to the positive polarity by the conductive roller 22. In this mode, a part of the remaining discharge toner can be adhered again to the conductive roller 22. At the end of the post-rotation mode, it is preferable that the toner cannot be adhered to the conductive roller 22 as much as possible. In order to realize a state in which the toner is not adhered to the conductive roller 22, it is required to reduce an amount of the remaining discharge toner adhered again to the conductive roller 22 in the post-rotation mode as much as possible.

Thus, an amount of the discharge toner to be collected to the photosensitive drum 1 is increased to suppress the re-adhesion of the remaining discharge toner to the conductive roller 22. More specifically, at a timing at which the discharge toner reaches the primary transfer nip portion, the exposure device 3 performs exposure of the surface of the photosensitive drum 1. By the exposure, the surface potential of the photosensitive drum 1 is immediately attenuated to a voltage of about −100 V having a small absolute value with the same polarity as that of the normal charging polarity of the toner. A voltage of about −1000 V is applied to the primary transfer roller 10, and the surface of the photosensitive drum 1 is exposed. Therefore, a potential difference ranges about 800 V to 900 V between the surface of the intermediate transfer belt 9 and the surface of the photosensitive drum 1 in the primary transfer nip portion.

When the photosensitive drum 1 is charged by the charging roller 22 to which the voltage of about −1100 V is applied, the surface potential of the photosensitive drum 1 is −550 V. Thus, in the case where the exposure device 3 does not perform the exposure, the potential difference ranges about 350 V to 450 V between the surface of the intermediate transfer belt 9 and the surface of the photosensitive drum 1 in the primary transfer nip portion. According to the present exemplary embodiment, the exposure device 3 performs the exposure to collect the remaining discharge toner, thereby generating a large potential difference, i.e., about 800 V. Consequently, the discharge toner is easily influenced by an effect of an electrical field, and it is possible to increase the amount of collection of the discharge toner to the photosensitive drum 1.

Figure 2A:
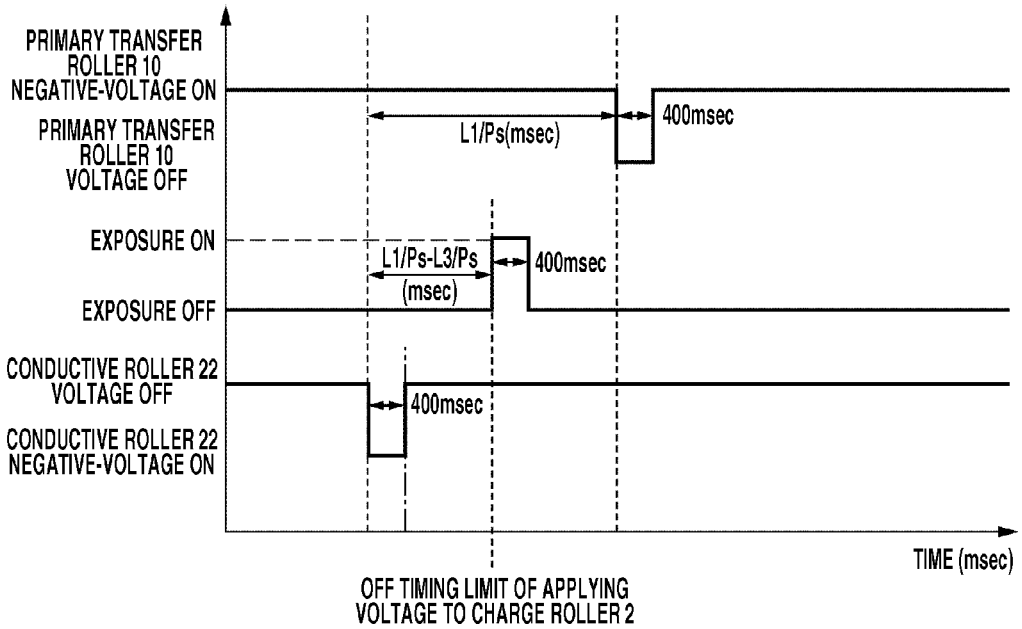
FIGS. 2A and 2B illustrate timing charts of exposure when collecting a discharge toner according to the first exemplary embodiment.
Figure 2B:
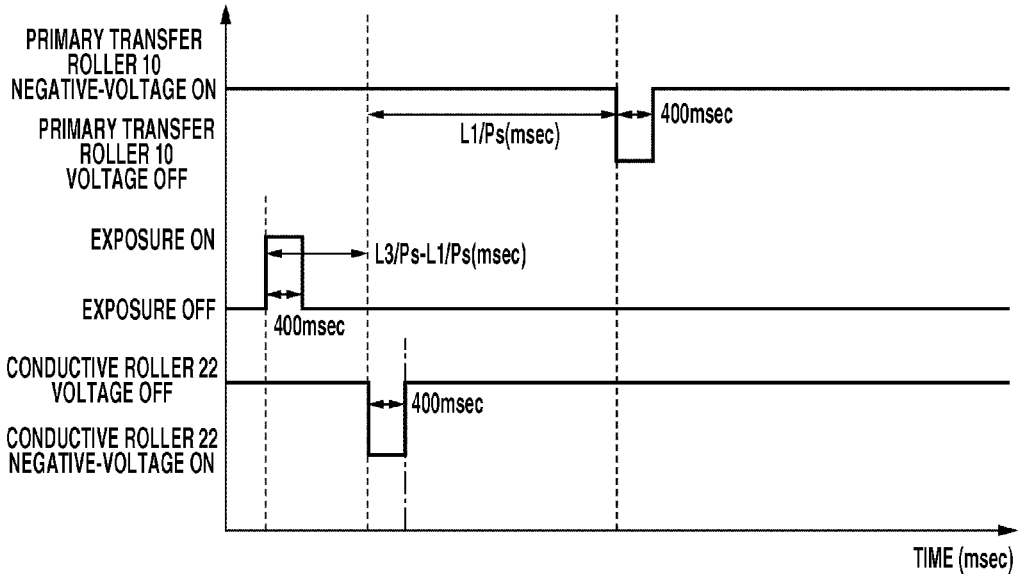

FIGS. 2A and 2B illustrate timing charts of applying voltages to the conductive roller 22 and the primary transfer roller 10 and exposure. It is assumed that a distance is L3 (mm) between an exposure portion 3*a*, which is an exposure position of the exposure device 3 on the photosensitive drum 1, and the primary transfer nip portion in the rotational direction of the photosensitive drum 1. Further, a distance is L1 (mm) between the contact position of the conductive roller 22 and the primary transfer nip portion in the rotational direction of the intermediate transfer belt 9. Furthermore, the rotational velocity of the intermediate transfer belt 9 and the rotational velocity of the photosensitive drum 1 are Ps (mm/sec).

It takes L3/Ps that the surface of the photosensitive drum 1 whose potential is adjusted by the charging roller 2 reaches the primary transfer nip portion. If L1/Ps≥L3/Ps, the exposure device 3 may perform the exposure by (L1/Ps−L3/Ps) at the latest after the discharge of toner to the conductive roller 22. If L1/Ps≤L3/Ps, the exposure device 3 may perform the exposure before (L3/Ps−L1/Ps) at the latest from the discharge of toner to the conductive roller 22.

According to the present exemplary embodiment, the surface of the photosensitive drum 1 is exposed when the discharge toner is collected, and a reach timing of the surface of the photosensitive drum 1 with a voltage of about −100 V to the primary transfer nip portion is made synchronous with or earlier than a reach timing of the discharge toner to the primary transfer nip portion. Thus, a large amount of the discharge toner can be collected to the photosensitive drum 1.

Figure 3:
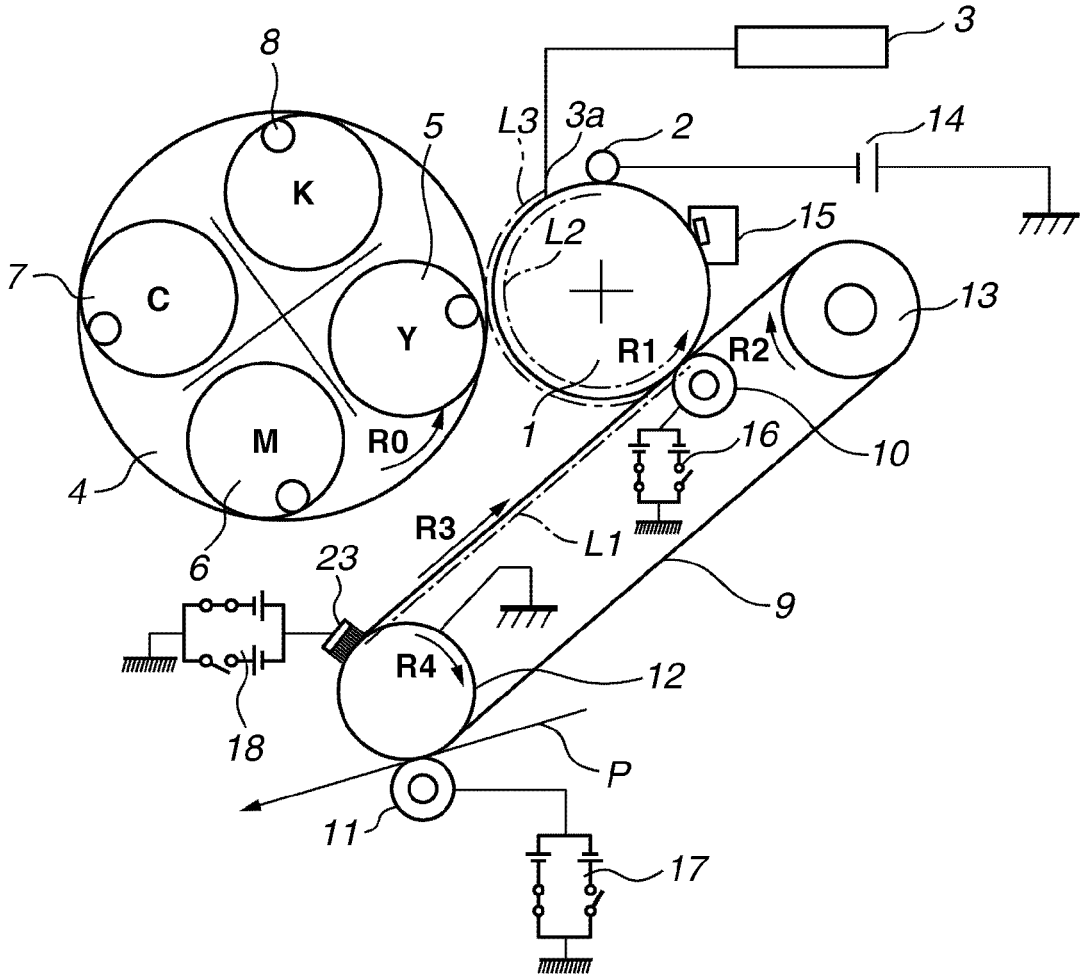
FIG. 3 illustrates a schematic configuration of an image forming apparatus according to a second exemplary embodiment.

FIG. 3 illustrates a schematic configuration of an image forming apparatus according to a second exemplary embodiment. Unlike the first exemplary embodiment, as the charging member, a conductive brush 23 is used in place of the conductive roller 22 in the second exemplary embodiment. Other configurations are similar to those according to the first exemplary embodiment. The conductive brush 23 is fixed to a support member. A brush portion of the conductive brush 23 is slid with a difference of circumferential velocity from the intermediate transfer belt 9.

The conductive brush 23 contains conductive nylon fibers with a fiber diameter of 20 μm, weaved with a density of 120 fibers per square millimeter. The conductive brush 23 includes a high-voltage power supply 19 that applies the positive and negative polarity voltages thereto. The high-voltage power supply 19 can apply a voltage ranging from −2000 V to +4000 V.

As compared with the conductive roller 22 according to the first exemplary embodiment, the conductive brush 23 can level the remaining toner to a uniform layer when contacting with the remaining toner in the secondary transfer. However, the conductive brush 23 accumulates a larger amount of the remaining toner, as compared with the conductive roller 22 according to the first exemplary embodiment. Therefore, only one-time application of the negative polarity voltage to the conductive brush 23 is not enough to sufficiently discharge the toner to the conductive roller 22. In such a case, applying a negative polarity voltage plural times is effective to discharge the toner. The remaining toner adhered to the conductive brush 23 mainly contains the toner with negative polarity. However, with attraction to the negative polarity toner, the remaining toner contains a part of the positive polarity toner.

Figure 4:
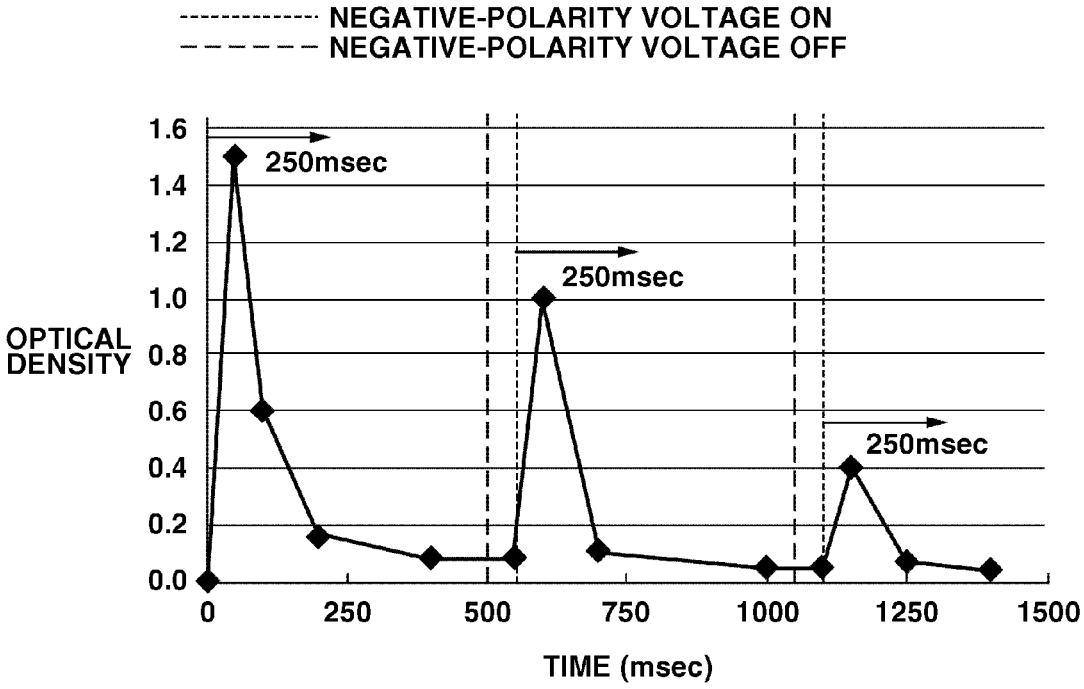
FIG. 4 illustrates a graph of a measurement result of an amount of discharge toners from a conductive brush 23.

Therefore, according to the present exemplary embodiment, in order to discharge a larger amount of the toner from the conductive brush 23, positive and negative polarity voltages are alternately applied to the conductive brush 23. FIG. 4 illustrates a graph of a measurement result of an optical density of an amount of the discharge toner when the negative polarity voltage was applied to the conductive brush 23. Referring to FIG. 4, the amount of the discharge toner was checked when applying a voltage of about −1000 V to the conductive brush 23 for 500 milliseconds by three times. The amount of the toner discharged from the conductive brush 23 was the largest at a moment for applying the voltage. Obviously, the amount of the discharge toner was sharply reduced with the time elapse. Further, obviously, the amount of the discharge toner was saturated for a time period for applying the voltage, i.e., 250 milliseconds. It is understood that, when stopping the voltage application and starting the application again, the amount of the discharge toner was increased again. The tendency was similar to the case of applying a positive polarity voltage.

According to the present exemplary embodiment, for the toner discharge, voltages of −1000 V and +1000 V are applied to the conductive brush 23 in this order alternately for 250 milliseconds each and by the total of three times for each voltage. The discharged toners alternately have the positive and negative polarities. More specifically, when the voltage of −1000 V was applied to the conductive brush 23, the discharge toner mainly had the negative polarity. When the voltage of +1000 V was applied to the conductive brush 23, the discharge toner mainly had the positive polarity.

Further, the collection of the discharge toner to the photosensitive drum 1 requires adjustment of the surface potential of the photosensitive drum 1 according to the polarity of the discharge toner. Therefore, according to the present exemplary embodiment, the exposure timing of the exposure device 3 is switched according to the polarity of the discharge toner that reaches the primary transfer nip portion. In other words, the exposed surface corresponds to a drum surface for collecting the discharge toner with the negative polarity. The unexposed surface corresponds to a drum surface for collecting the discharge toner with the positive polarity. According to the toner polarity, voltages of about −1000 V and about +1000 V are alternately applied to the primary transfer roller 10.

Figure 5A:
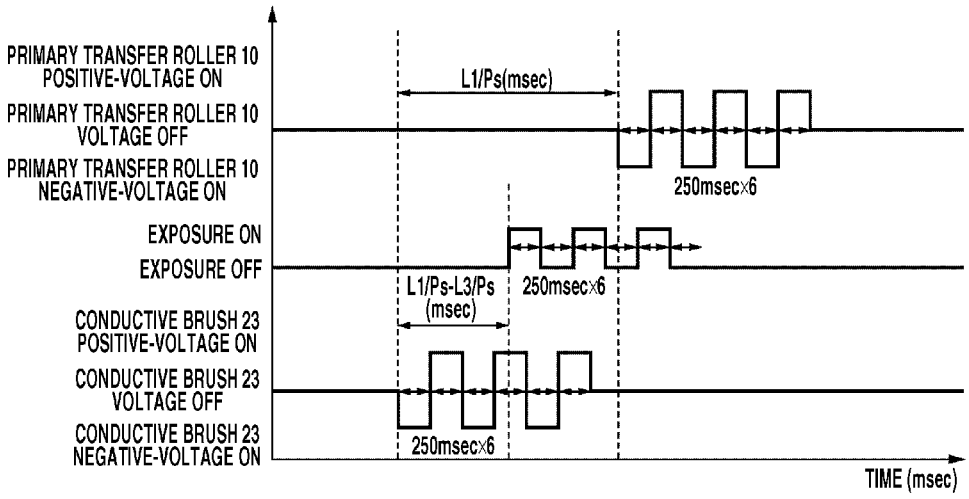
FIGS. 5A and 5B illustrate timing charts of exposure when collecting the discharge toner according to the second exemplary embodiment.
Figure 5B:
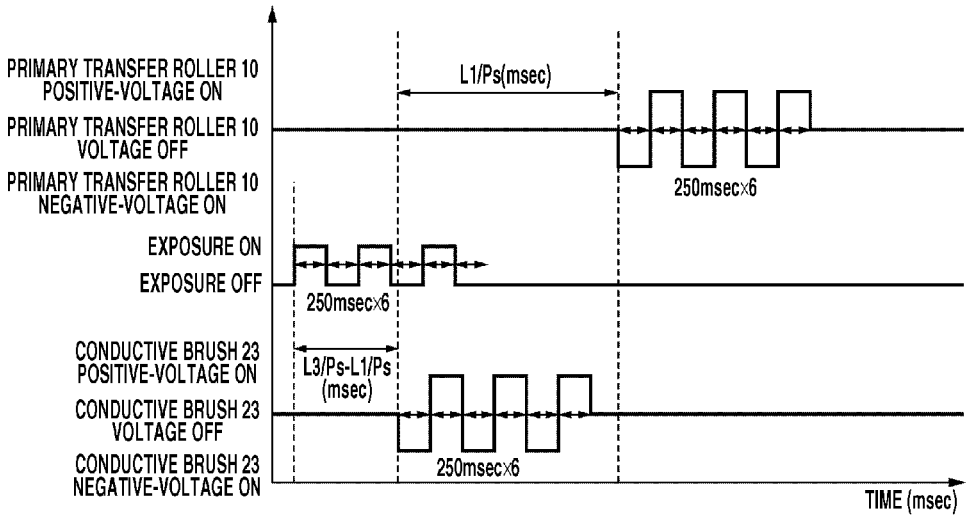

FIGS. 5A and 5B illustrate timing charts for applying voltages to the conductive brush 23 and the primary transfer roller 10 and the exposure. If L1/Ps≥L3/Ps, the exposure is performed for 250 milliseconds, starting at a time after (L1/Ps−L3/Ps) from the first discharge of the toner with the negative polarity from the conductive brush 23. Then, the exposure is alternately switched on and off for 250 milliseconds each. The number of switching times is three for the exposure and the un-exposure, respectively.

If L1/Ps≤L3/Ps, the exposure is performed for 250 milliseconds, starting at a time before (L1/Ps−L3/Ps) from the first discharge of the toner from the conductive brush 23. Then, the exposure is alternately switched on and off for 250 milliseconds each.

The voltages of about −1000 V and about +1000 V may be alternately applied to the primary transfer roller 10 for 250 milliseconds each, starting at a time after L1/P2 from the toner discharge from the conductive brush 23.

Accordingly, if discharging the toner charged with the negative and positive polarities from the conductive brush 23, the toner can be efficiently transferred from the intermediate transfer belt 9 to the photosensitive drum 1 in the primary transfer nip portion.

According to a third exemplary embodiment, a description is given of selection of an adjustment method of the surface potential of the photosensitive drum 1 in consideration of consumption of the exposure device 3 and the amount of discharge toner. An image forming apparatus according to the present exemplary embodiment is similar to the image forming apparatus according to the second exemplary embodiment. Similarly to the second exemplary embodiment, in the toner discharge mode, the voltages of −1000 V and +1000 V are applied to the conductive brush 23 in this order alternately for 250 milliseconds each and by the total of three times each.

According to the first exemplary embodiment, the surface of the photosensitive drum 1 is exposed to improve the amount of collection of the discharge toner. However, performing exposure for every post-rotation mode increases the number of using times of the exposure device 3. The adjustment method of the surface potential of the photosensitive drum 1 includes adjustment of a voltage applied to the charging roller 2 as the charging member for the image carrier as well as the exposure.

Figure 6:
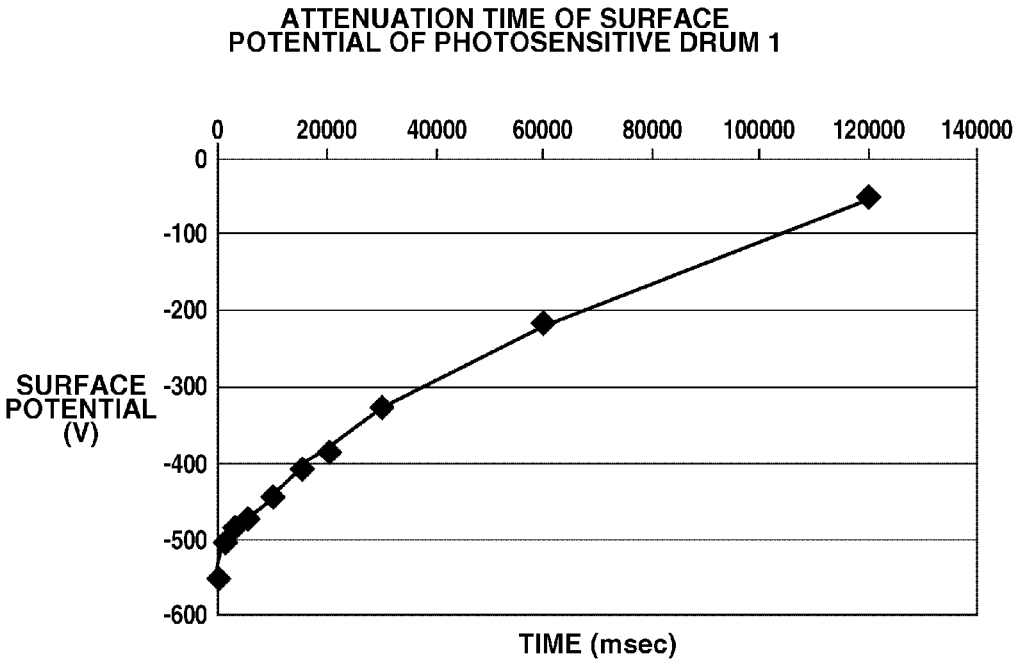
FIG. 6 illustrates a graph of a measurement result of an attenuation time of a surface potential when a voltage of a charging roller 2 is 0 V.

FIG. 6 illustrates a graph of a measurement result of a attenuation time of the surface potential of the photosensitive drum 1 at the position where the developing devices 5, 6, 7, and 8 come into contact with the photosensitive drum 1 when a voltage applied to the charging roller 2 was 0 V. In the present measurement, a voltage of 0 V was applied to the primary transfer roller 10. Referring to FIG. 6, it took two minutes or more from the time when the voltage applied to the charging roller 2 was 0 V to the time when the surface potential of the photosensitive drum 1 was attenuated close to 0 V. However, as illustrated in FIG. 6, it took a relatively short time for the surface potential of the photosensitive drum 1 to be attenuated to about −300 V from when a voltage applied to the charging roller was set to 0 V.

If printing an image at a small printing ratio with the toner, such as a character image, the amount of remaining toner is small. Therefore, in the cleaning mode, the amount of toner adhered to the conductive brush 23 is small and the amount of discharge toner is thus small. In such a case, the discharge toner can be sufficiently collected to the photosensitive drum 1 by setting the voltage applied to the charging roller 2 to 0 V in many cases. Thus, the present exemplary embodiment can select whether the exposure device 3 exposes the surface of the photosensitive drum 1 or the voltage applied to the charging roller 2 is set to 0 V according to the amount of discharge toner.

More specifically, if the printing ratio with the toner is high or if the number of continuous printed sheets is large as conditions of a large amount of discharge toner, the exposure device 3 performs the exposure. On the other hand, if the printing ratio with the toner is low and the number of continuous printed sheets is small as conditions of a small amount of discharge toner, the voltage applied to the charging roller 2 is set to 0 V.

Figure 7:
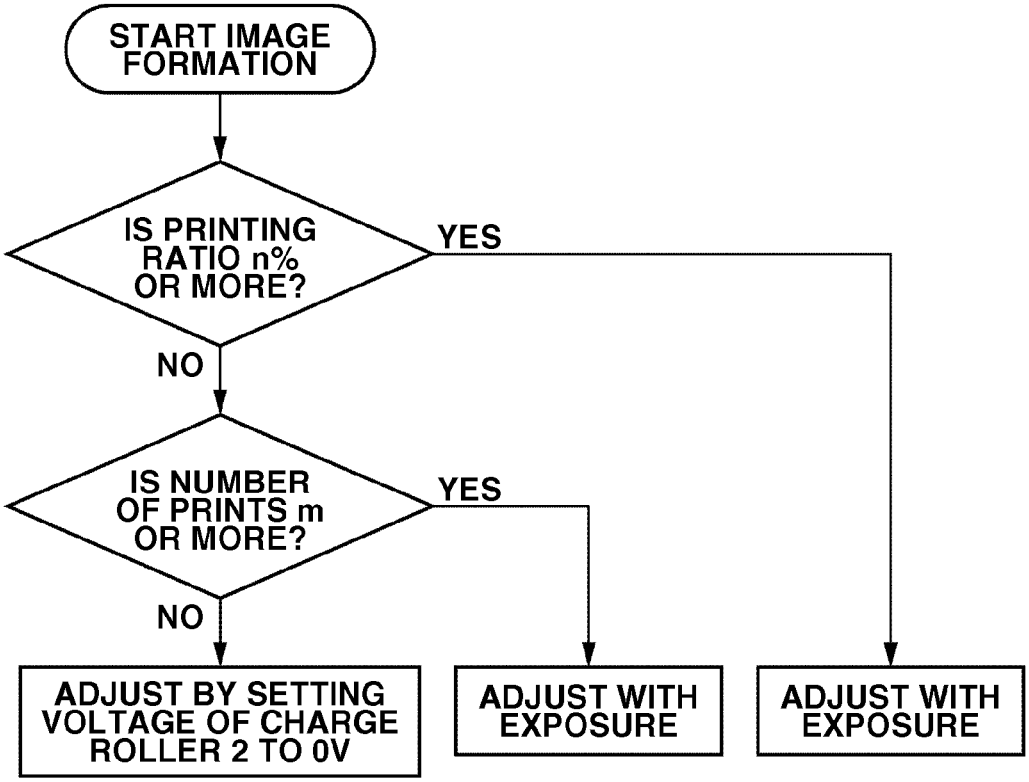
FIG. 7 illustrates a flowchart for selecting an adjustment method of a surface potential on a photosensitive drum 1.
Figure 8A:
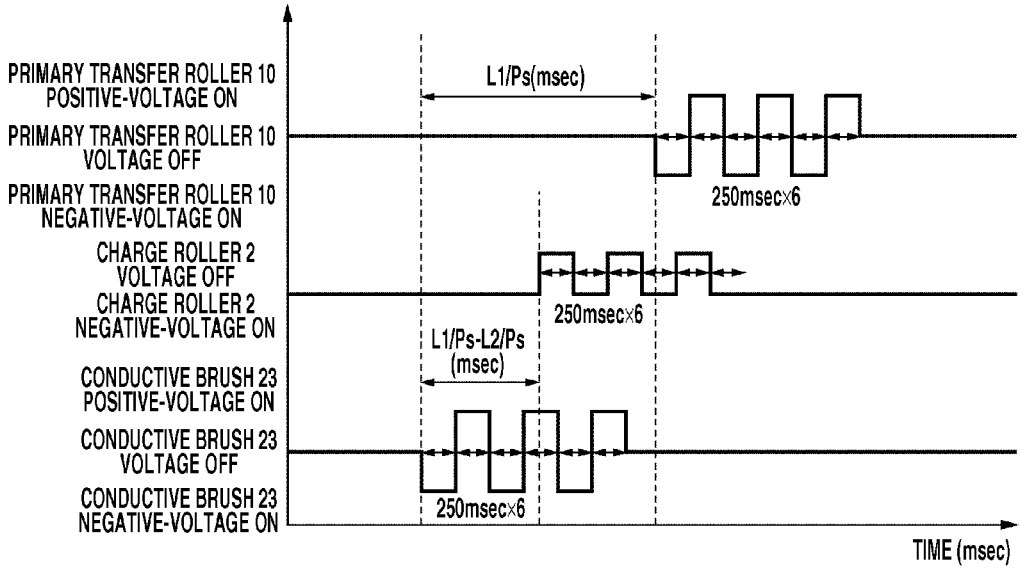
FIGS. 8A and 8B illustrate timing charts of applying voltages to a charging roller 2 when collecting a discharge toner according to a third exemplary embodiment.
Figure 8B:
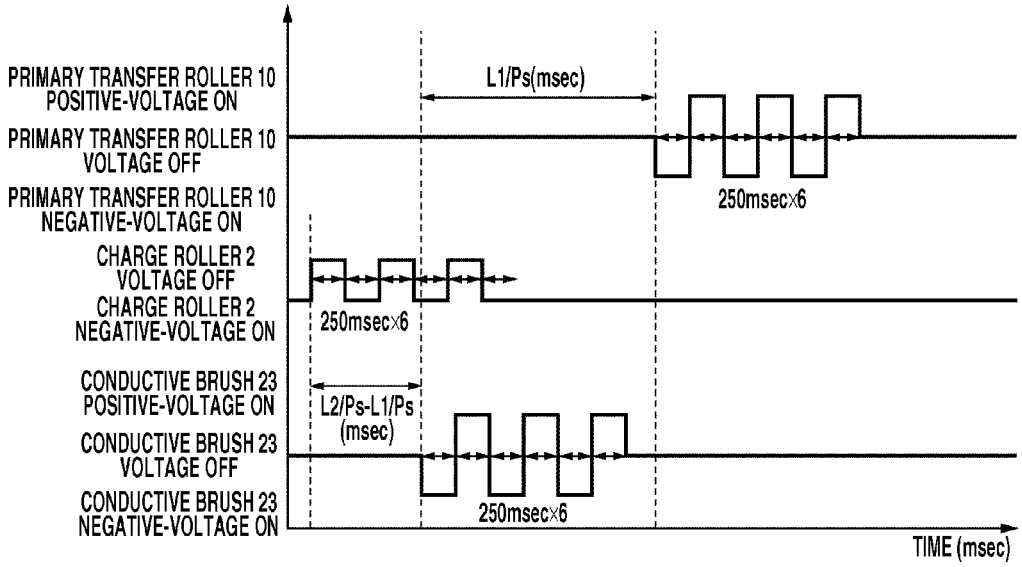

FIG. 7 illustrates a flowchart of selection processing. Here, the printing ratio is defined to n %. The printing ratio of a one-color solid image is defined to 100%. The number of continuous printed sheets is defined to m sheets. If the printing ratio is a predetermined value or less and the number of continuous printed sheets is a predetermined number or less, the voltage applied to the charging roller 2 is set to 0 V. If the above described conditions are not satisfied, the exposure is performed. According to the present exemplary embodiment, a predetermined value for the printing ratio n % is set to 7%. Further, a predetermined number for the number m of continuous printed sheets is set to 2. The printing ratio and the number of continuous printed sheets maybe set according to an actual using situation of a user with the specification of the image forming apparatus.

According to the present exemplary embodiment, the adjustment method of the surface potential of the photosensitive drum 1 can be selected according to the printing ratio with the toner and the number of continuous printed sheets. If it is expected that the amount of the discharge toner is large, the discharge toner is efficiently collected to the photosensitive drum 1 by performing the exposure using the exposure device 3. On the other hand, if it is expected that the amount of discharge toner is small, the voltage applied to the charging roller 2 is set to 0 V, thereby adjusting the surface potential of the photosensitive drum 1. Hence, the discharge toner can be collected to the photosensitive drum 1 without fail and the consumption of the exposure device 3 can be suppressed.

Similarly to the second exemplary embodiment, the voltages of −1000 V and +1000 V may be alternately applied to the conductive brush 23 for 250 milliseconds each by the total of three times for each voltage to discharge the toner with the positive and negative polarities to the intermediate transfer belt 9. In this case, the toner discharged to the photosensitive drum 1 can be collected without fail by changing the voltage applied to the charging roller 2.

More specifically, a region of the photosensitive drum 1 charged by the applied voltage of 0 V may reach the primary transfer nip portion, synchronously with a timing when the discharge toner with the negative polarity on the intermediate transfer belt 9 reaches the primary transfer nip portion. Further, a region of the photosensitive drum 1 charged by the applied voltage of −1100 V may reach the primary transfer nip portion, synchronously with a timing when the discharge toner with the positive polarity on the intermediate transfer belt 9 reaches the primary transfer nip portion.

According to a fourth embodiment, the exposure is performed according to the first exemplary embodiment, and at the same time, the voltage applied to the charging roller 2 is set to 0 V. As described in the first exemplary embodiment, when the exposure is performed in the state in which the voltage of about −1100 V is applied to the charging roller 2, the surface potential of the photosensitive drum 1 becomes immediately about −100 V. On the other hand, when the exposure is performed in the state that the voltage of 0 V is applied to the charging roller 2 and the surface potential of the photosensitive drum 1 is attenuated in advance, the surface potential of the photosensitive drum 1 comes further closer to 0 V from about −100 V.

Figure 9A:
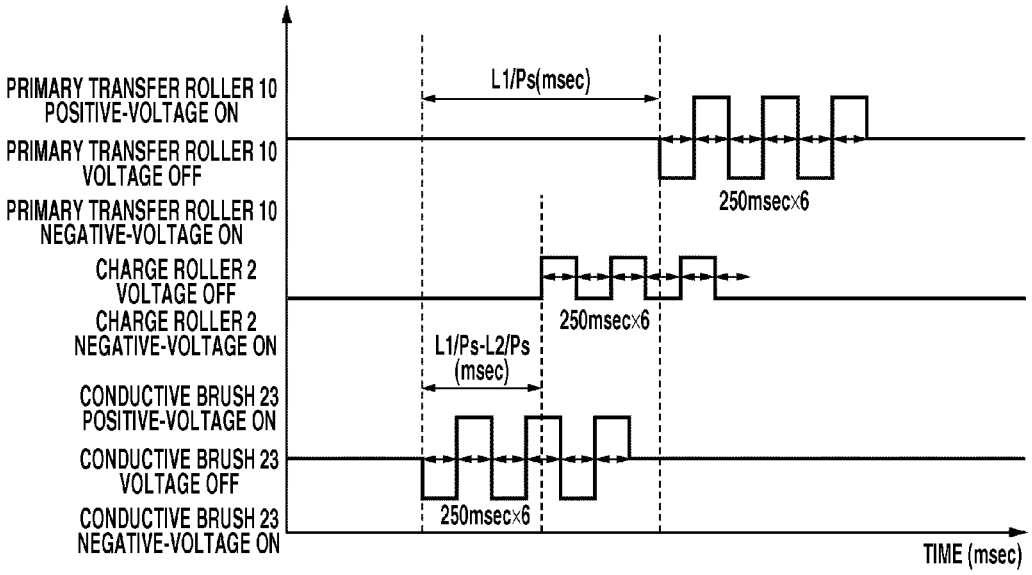
FIGS. 9A and 9B illustrate timing charts of applying a voltage to a charging roller 2 and exposure according to a fourth exemplary embodiment.
Figure 9B:
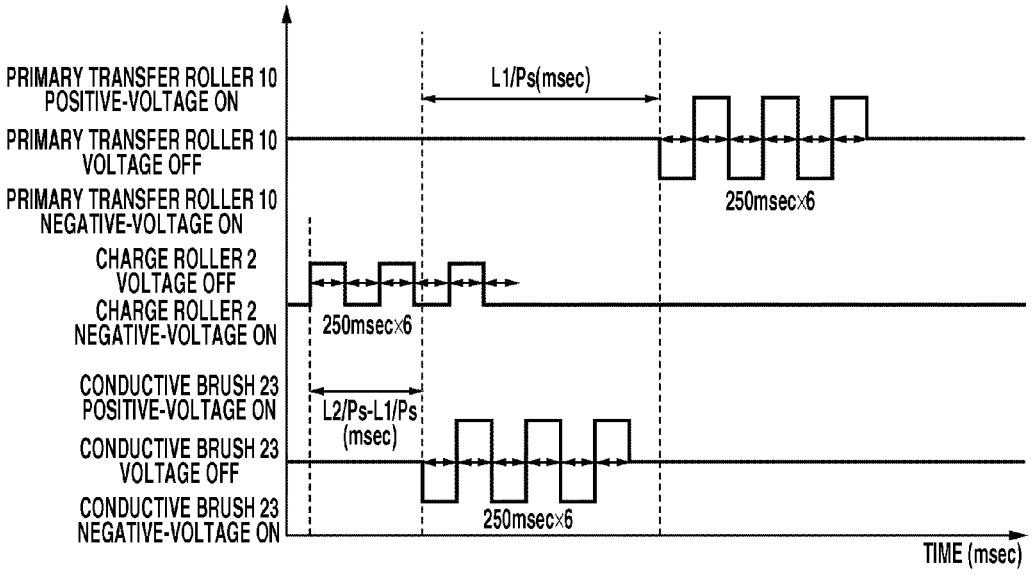

Consequently, the amount of collection of the discharge toner is also improved. According to the present exemplary embodiment, in the discharge mode, the voltages of about −1000 V and about +1000 V are alternately applied to the conductive brush 23 for 250 milliseconds by the total of three times for each voltage similarly to the second exemplary embodiment. FIGS. 9A and 9B illustrate timing charts of exposure and applying voltages to the charging roller 2. Similar to the second exemplary embodiment, timings of the exposure and the application of voltage to the charging roller 2 may be adjusted at the reach timing of the discharge toner to the primary transfer portion.

According to the present exemplary embodiment, the surface potential of the photosensitive drum 1 is adjusted by performing the exposure and setting the voltage applied to the charging roller 2 to 0 V. As a result, the amount of collection of the discharge toner can be improved.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-243804 filed Oct. 29, 2010, which is hereby incorporated by reference herein in its entirety.

What is claimed is:

1. An image forming apparatus comprising:

an image carrier configured to carry a toner image;

a first charging member configured to charge the image carrier;

a first voltage-application unit configured to apply a negative polarity voltage with a same polarity as that of a normal charging polarity of a toner to the first charging member;

an exposure unit configured to expose the image carrier to light;

a movable intermediate transfer member;

a primary transfer member configured to primarily transfer the toner image from the image carrier to the intermediate transfer member in a primary transfer portion;

a secondary transfer member configured to secondarily transfer the toner image from the intermediate transfer member to a transfer material in a secondary transfer portion; and a second charging member configured to charge a remaining toner that remains on the intermediate transfer member upstream of the primary transfer portion and downstream of the secondary transfer portion in a movement direction of the intermediate transfer member, wherein the image forming apparatus can execute a first mode for charging the remaining toner by the second charging member and transferring the charged remaining toner from the intermediate transfer member to the image carrier in the primary transfer portion, and execute a second mode for transferring the remaining toner adhered to the second charging member in the first mode from the second charging member to the intermediate transfer member, and in response to the image forming apparatus executing the second mode, the image forming apparatus controls the first voltage-application unit or the exposure unit so that a surface potential of the image carrier that reaches the primary transfer portion at a timing at which the remaining toner transferred from the second charging member to the intermediate transfer member passes through the primary transfer portion has a same polarity as that of a surface potential of the image carrier in the first mode and also has an absolute value smaller than that thereof.

2. The image forming apparatus according to claim 1, further comprising:

a second voltage-application unit configured to apply a positive polarity or a negative polarity voltage to the second charging member, wherein, in response to the image forming apparatus executing the second mode, the second voltage-application unit applies the negative polarity voltage to the second charging member to transfer a negative polarity toner from the second charging member to the intermediate transfer member.

3. The image forming apparatus according to claim 2, wherein the surface potential of the image carrier that reaches the primary transfer portion at the timing in the second mode has an absolute value smaller than that of the surface of the image carrier in the first mode by being exposed by the exposure unit.

4. The image forming apparatus according to claim 2, wherein, in response to the image forming apparatus executing the second mode, the second voltage-application unit alternately applies the negative polarity voltage and the positive polarity voltage to the second charging member to alternately transfer a negative toner and a positive toner from the second charging member to the intermediate transfer member.

5. The image forming apparatus according to claim 4, wherein, in response to the image forming apparatus executing the second mode, the exposure unit exposes, to the light, the surface of the image carrier that reaches the primary transfer portion at a timing at which the negative polarity toner transferred from the second charging member to the intermediate transfer member passes through the primary transfer portion, and the exposure unit does not expose, to the light, the surface of the image carrier that reaches the primary transfer portion at a timing at which the positive polarity toner transferred from the second charging member to the intermediate transfer member passes through the primary transfer portion.

6. The image forming apparatus according to claim 1, wherein the second charging member is a conductive brush.

7. The image forming apparatus according to claim 1, wherein the surface potential of the image carrier that reaches the primary transfer portion at the timing in the second mode has an absolute value smaller than that of the surface potential of the image carrier in the first mode by setting an output from the first voltage-application unit to be small.

8. The image forming apparatus according to claim 1, wherein, in response to a printing ratio in image formation before the first mode having a predetermined value or more, the image forming apparatus causes the exposure unit to execute exposure while executing the second mode.

9. The image forming apparatus according to claim 8, wherein, in response to a printing ratio being smaller than the predetermined value and a number of sheets subjected to image formation being smaller than a predetermined number, the image forming apparatus reduce an output from the first voltage-application unit while executing the second mode.

* * * * *